US006712330B1

(12) United States Patent
Damiano

(10) Patent No.: US 6,712,330 B1
(45) Date of Patent: Mar. 30, 2004

(54) SUPPORT POLE

(75) Inventor: Armand A. Damiano, Chantilly, VA (US)

(73) Assignee: Valmont Industries, Inc., Valley, NE (US)

( * ) Notice: Subject to any disclaimer, the term of this patent is extended or adjusted under 35 U.S.C. 154(b) by 0 days.

(21) Appl. No.: 10/336,873

(22) Filed: Jan. 3, 2003

(51) Int. Cl.[7] ..... F16M 13/00
(52) U.S. Cl. ..... 248/519; 248/535
(58) Field of Search ..... 248/519, 523, 248/535, 539, 511, 314, 315, 346.03, 900; 52/295, 296, 297, 298, 301

(56) References Cited

U.S. PATENT DOCUMENTS 3,645,057 A * 2/1972 Kaplan ..... 52/295
3,839,835 A * 10/1974 Meyer ..... 52/296
3,942,296 A * 3/1976 Meyer ..... 52/296
4,079,559 A * 3/1978 Tenbrummeler ..... 52/295
5,481,846 A 1/1996 Macchietto ..... 52/720.1
5,687,537 A * 11/1997 Noble ..... 52/726.3
5,946,871 A * 9/1999 Kassardjian et al. ..... 52/301

* cited by examiner

*Primary Examiner*—Leslie A. Braun
*Assistant Examiner*—A. Joseph Wujciak, III
(74) *Attorney, Agent, or Firm*—Thomte, Mazour & Niebergall; Dennis L. Thomte

(57) ABSTRACT

A support pole including a base having a hollow shaft secured thereto. The base is attached to the footing and includes a plate portion having a generally cylindrical portion extending upwardly therefrom. The bottom surface of the plate portion has a cut-out portion formed therein which communicates with the central opening formed in the base. A hollow shaft is inserted into the central opening in the base so that the lower end thereof is substantially flush with the bottom surface of the plate portion. The shaft is secured to the base by a weldment in the cut-away portion. The shaft is also secured to the base by means of an enlarged diameter portion or protrusion formed in the shaft immediately above the upper end of the base. The base may also be comprised of a flat plate portion without the cylindrical portion. Further, the base may have a square portion extending upwardly therefrom to accommodate a square pole. If a square pole is being used, the central opening in the base plate will be square.

12 Claims, 3 Drawing Sheets

SUPPORT POLE

BACKGROUND OF THE INVENTION

1. Field of the Invention

This invention relates to a support pole comprising a hollow shaft extending upwardly from a base which is secured to a footing and more particularly to a means for providing a mechanical connection of the shaft to the base.

2. Description of the Related Art

Support poles for supporting lights, etc., thereon are commonly constructed of a metal material such as aluminum or steel. In most instances, the support pole comprises a pole member or shaft which is secured to a base which in turn is secured to a concrete footing. The base is normally comprised of a substantially flat baseplate or plate portion having a generally cylindrical portion extending upwardly therefrom. The base is sometimes comprised of a flat baseplate portion only without a cylindrical portion. When the shaft is comprised of aluminum or steel, the shaft is normally welded to the metal baseplate. If the shaft is constructed of aluminum, the welding operation may weaken the shaft in the area of the weldment which is commonly referred to as a heat affected zone (HAZ).

A typical prior art support pole construction is illustrated in FIG. 2 wherein the numeral 10 refers to a base 10 including a plate portion 12 having a generally cylindrical portion 14 extending upwardly therefrom with the cylindrical portion 14 including a central opening 15 defined by surface 16. The hollow metal shaft 18 is positioned in the central opening 15 of the base 10 so that the lower end 20 of the shaft 18 is spaced above the bottom surface 22 of the plate portion 12 of base 10. The lower end 20 of the shaft 18 is welded to the base 10 at 22. In some cases, the outer surface of the shaft 18 is welded to the upper end of the base 10 by weldment 24. Normally, central opening 15 has a slight taper or draft to facilitate the removal of the base 10 from the mold if the base 10 is a casting. Such draft or taper results in a small gap 23 which makes welding more difficult at quality levels.

Although the prior art method of securing the shaft to the base in FIG. 2 is extensively used in the industry, the same has certain disadvantages. First, two heat affected zones (HAZ) are created due to the weldments 22 and 24. Second, the use of two weldments increases the cost of fabricating the assembly. Third, since the lower end of the shaft 18 is spaced above the bottom surface 22 of the base 10, a taller base 10 is required as a way of transferring the loads away from the weldments.

SUMMARY OF THE INVENTION

A support pole is described which includes a horizontally disposed base for attachment to a footing with the base including a plate portion, having a bottom surface, and a generally cylindrical portion extending upwardly therefrom. The base has a central opening formed therein which extends between the upper and lower ends thereof. The plate portion has an annular cut-away portion formed in its bottom surface which communicates with the lower end of the central opening. A hollow metal shaft is inserted into the central opening of the base so that its lower end is substantially flush with the bottom surface of the plate portion. A weldment is provided in the annular cutaway portion which welds the outer surface of the lower end of the shaft to the base. The shaft has an enlarged diameter portion immediately above the upper end of the base. The single weldment and the enlarged diameter portion on the shaft securely attach the shaft to the base. In another embodiment, the cylindrical portion is omitted from the base. Further, the cylindrical portion may be replaced with a square portion to accommodate square shafts.

In some cases, the base will be comprised of a flat baseplate portion without a cylindrical portion.

It is therefore a principal object of the invention to provide an improved support pole.

Still another object of the invention is to provide a mechanical connection for the shaft of the pole to a base which requires only a single weldment.

These and other objects will be apparent to those skilled in the art.

DESCRIPTION OF THE PREFERRED EMBODIMENT

Figure 1:
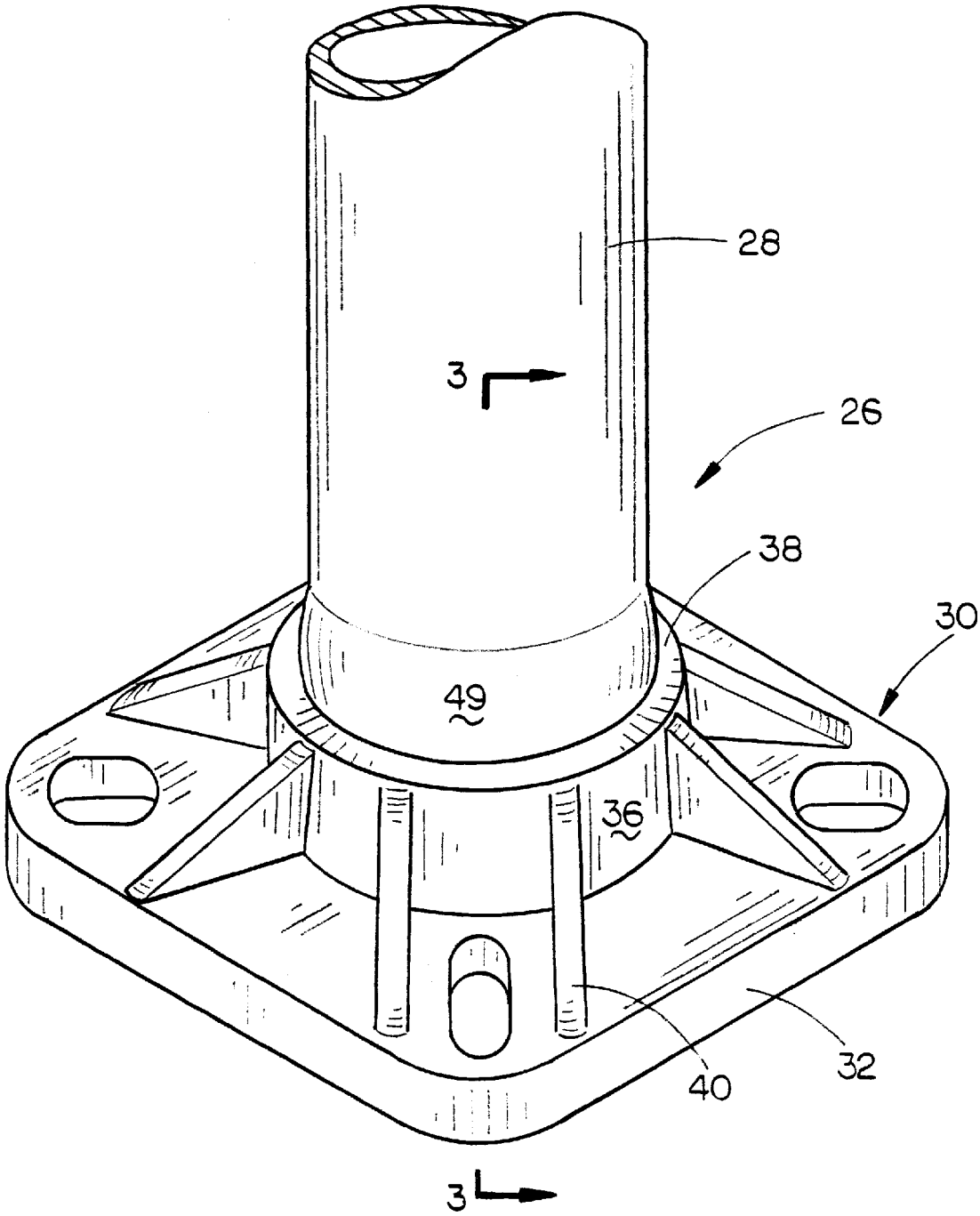
FIG. 1 is a partial perspective view of the support pole of this invention.

The support pole of this invention (FIGS. 1 and 3) is referred to generally by the reference numeral 26 and includes a hollow shaft or pole member 28 which is received by and which is secured to a base or base plate 30. Although the pole member 28 may be cylindrical, square or multi-sided, the invention will be described as being used with a cylindrical pole Shaft 28 will normally be comprised of an aluminum material but may be comprised of a steel material or the like. The base 30 may either be an aluminum casting or it may be formed by milling. The base 30 may also be comprised of a steel material.

Figure 3:
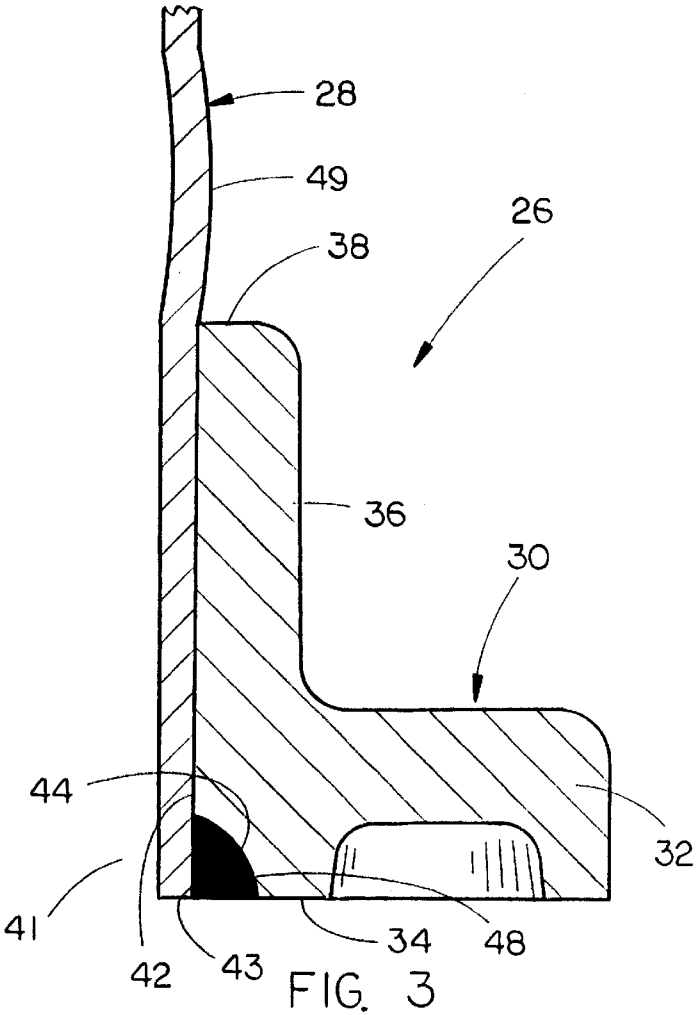
FIG. 3 is a sectional view as seen along lines 3—3 of FIG. 1.
Figure 2:
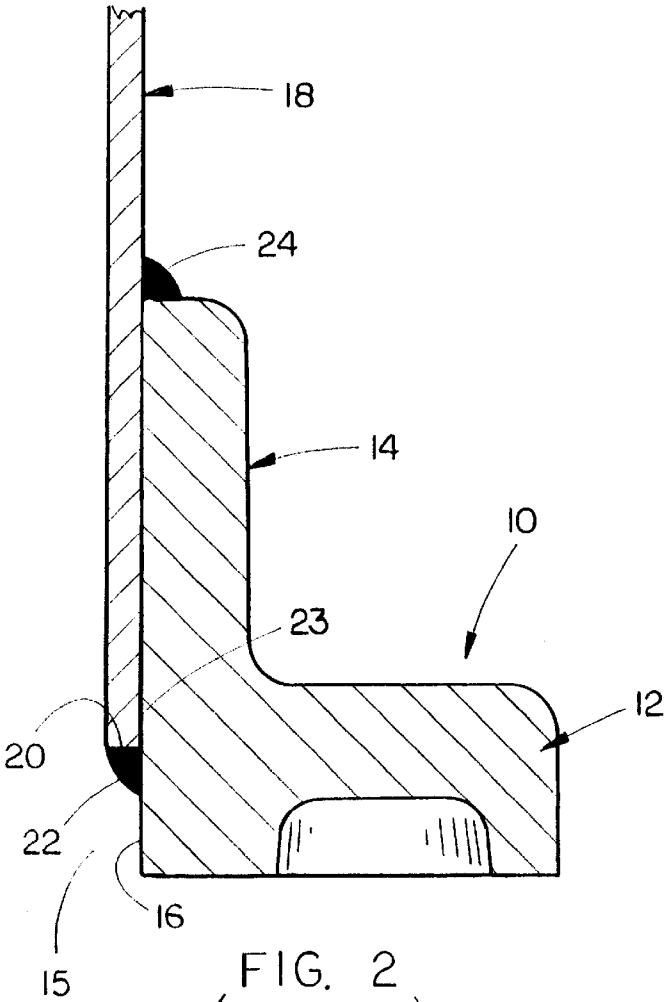
FIG. 2 (PRIOR ART)
FIG. 2 is a partial vertical sectional view of a prior art support pole.
Figure 4:
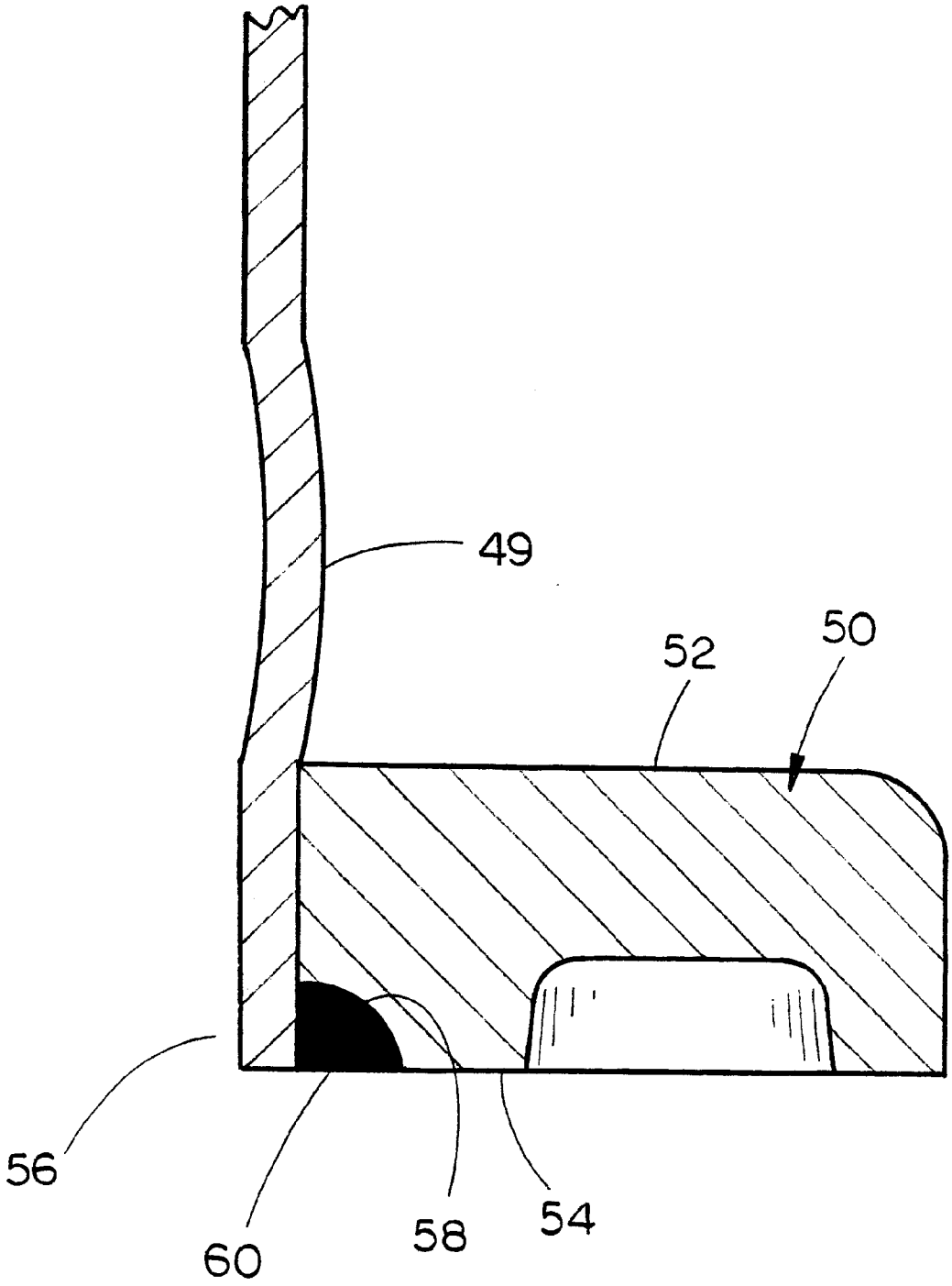
FIG. 4 is a sectional view of a modified form of the base.

Base 30 includes a plate portion 32 having a bottom surface 34. Base 30 also includes a generally cylindrical portion 36 (square if a square pole is being used) which extends upwardly from plate portion 32 and which has an upper end 38. Base 30 will normally be provided with webs or reinforcing members 40 extending between the plate portion 32 and a cylindrical portion 36. Base 30 has a central opening 41 extending therethrough which is defined by surface 42. Opening 41 will be square if a square pole is being used. A generally arcuate cut-away portion 44 is formed in base 30 which extends upwardly thereinto from bottom surface 36 of plate portion 32, as illustrated in FIG. 3. As illustrated in FIG. 3, the cut-away portion 44 communicates with the central opening 41. For purposes of description, shaft 28 will be including a lower end 43. In many instances, the base will include a plate portion without a cylindrical portion such as seen in FIG. 4.

Shaft 28 is extended downwardly into the central opening 41 so that its lower end 43 is substantially flush with bottom surface 34, as seen in FIG. 3. The outer surface 46 of the lower end of shaft 28 is welded to base 30 by a weldment 48 in cut-away portion 44. The welding operation may be either manual or robotic. The shape of the cut-away portion 44 lends itself to robotic welding since the welding tip of the robotic welder may be easily inserted into the cut-away portion 44 from the bottom of the support pole.

In some cases, there may be a small clearance between the outer surface 46 of shaft 28 and the surface 42 due to manufacturing tolerances. It is preferred that the lower end of shaft 28 be expanded outwardly into mechanical engagement with surface 42 and such is achieved by hydraulic expansion equipment to force shaft 28 outwardly into mechanical engagement with the base 30. It is also preferred that hydraulic expansion equipment or the like be used to expand the shaft 28 outwardly immediately above the upper end 38 of base 30 to create an enlarged diameter portion or protrusion 49. The protrusion 49 and the weldment 48 cooperate to securely lock or attach the shaft 28 to the base 30. The protrusion 49 is relatively small and therefore is not very noticeable. Hence, the visual appearance of the shaft is not adversely affected.

It can therefore be seen that a novel support pole has been provided which includes a shaft 28 secured to a base 30 by a single weldment 48 thereby reducing fabrication costs and which also results in a single HAZ. The method of attaching the shaft to the base of this invention also eliminates the need for a tall cylindrical portion on the base.

FIG. 4 illustrates a modified form of the base or baseplate. In FIG. 4, the base 50 does not have a cylindrical portion extending upwardly therefrom. Base 50 includes an upper surface 52 and a bottom surface 54. Base 50 has a central opening 56 formed therein which receives shaft 28 therein. Base 50 has an arcuate cut-away portion 58 formed therein which is identical to cut-away potion 48 on base 30. The lower outer end of shaft 28 is welded to base 50 by means of a weldment 60 in cut-away portion 58. Preferably, the shaft 28 has a protrusion or enlarged diameter portion 49 formed therein immediately above the upper surface 52 of base 50 for the same purpose as that in FIG. 3.

As in the embodiment of FIG. 3, it is preferred that the shaft 28 be secured to the base 50 by both the weldment 60 and the protrusion 49. However, the protrusion 49 may be omitted in some cases.

The use of the invention described herein makes it possible to eliminate all but a thick base plate since the invention allows for better load transfer (i.e., higher load transfer to weld) and hence a shorter casting height is needed.

Thus it can be seen that the invention accomplishes at least all of its stated objectives.

I claim:

1. A support pole, comprising:

a horizontally disposed metal base, having upper and lower ends, for attachment to a footing;

said base including a plate portion having a generally cylindrical portion extending upwardly therefrom;

said plate portion having a bottom surface;

said generally cylindrical portion of said base having an upper end;

said base having a central opening formed therein which extends between said upper and lower ends;

said plate portion having an annular cut-away portion formed in its bottom surface extending upwardly into said plate portion which communicates with said central opening;

a hollow metal shaft having upper and lower ends and inner and outer surfaces;

said shaft being received by said central opening in said base so that its lower end is substantially flush with said bottom surface of said plate portion;

a weldment in said annular cut-away portion which welds said outer surface of said lower end of said shaft to said base;

said shaft having an enlarged diameter portion immediately above said upper end of said base;

said enlarged portion having a diameter greater than said central opening.

2. A support pole, comprising:

a horizontally disposed metal base, having upper and lower ends, for attachment to a footing;

said base including a plate portion having a generally cylindrical portion extending upwardly therefrom;

said plate portion having a bottom surface;

said generally cylindrical portion of said base having an upper end;

said base having a central opening formed therein which extends between said upper and lower ends;

a hollow metal shaft having upper and lower ends and inner and outer surfaces;

said shaft being received by said central opening in said base so that its lower end is substantially flush with said bottom surface of said plate portion;

said lower end of said shaft being welded to said base;

said shaft having an enlarged diameter portion immediately above said upper end of said base;

said enlarged portion having a diameter greater than said central opening.

3. The support pole of claim 2 wherein said plate portion has a cut-away portion formed in its bottom surface extending upwardly thereinto which communicates with the lower end of said opening and wherein said lower end outer surface of said shaft is welded to said base by a weldment in said cut-away portion.

4. A support pole, comprising:

a horizontally disposed metal base, having upper and lower ends, for attachment to a footing;

said base having a bottom surface;

said base having a central opening formed therein which extends between said upper and lower ends;

said base having an annular cut-away portion formed in its bottom surface extending upwardly into said central opening;

a hollow metal shaft having upper and lower ends and inner and outer surfaces;

said shaft being received by said central opening in said base so that its lower end is substantially flush with said bottom surface of said base;

a weldment in said annular cut-away portion which welds said outer surface of said lower end of said shaft to said base;

said shaft having an enlarged diameter portion immediately above said upper end of said base;

said enlarged portion having a diameter greater than said central opening.

5. A support pole, comprising:

a horizontally disposed metal base, having upper and lower ends, for attachment to a footing;

said base having a bottom surface;

said base having a central opening formed therein which extends between said upper and lower ends;

a hollow metal shaft having upper and lower ends and inner and outer surfaces;

said shaft being received by said central opening in said base so that its lower end is substantially flush with said bottom surface of said base;

said lower end of said shaft being welded to said base;

said shaft having an enlarged diameter portion immediately above said upper end of said base;

said enlarged portion having a diameter greater than said central opening.

6. The support pole of claim 5 wherein said base has a cut-away portion formed in its bottom surface extending upwardly thereinto which communicates with the lower end of said opening and wherein said lower end outer surface of said shaft is welded to said base by a weldment in said cut-away portion.

7. A support pole, comprising:

a horizontally disposed metal base, having upper and lower ends, for attachment to a footing;

said base including a plate portion having a generally square portion extending upwardly therefrom;

said plate portion having a bottom surface;

said generally square portion of said base having an upper end;

said base having a central opening formed therein which extends between said upper and lower ends;

said plate portion having a square-shaped cut-away portion formed in its bottom surface extending upwardly into said plate portion which communicates with said central opening;

a hollow metal square shaft having upper and lower ends and inner and outer surfaces;

said shaft being received by said central opening in said base so that its lower end is substantially flush with said bottom surface of said plate portion;

a weldment in said cut-away portion which welds said outer surface of said lower end of said shaft to said base;

said shaft having an enlarged diameter portion immediately above said upper end of said base;

said enlarged portion having a diameter greater than said central opening.

8. A support pole, comprising:

a horizontally disposed metal base, having upper and lower ends, for attachment to a footing;

said base including a plate portion having a generally square portion extending upwardly therefrom;

said plate portion having a bottom surface;

said generally square portion of said base having an upper end;

said base having a central opening formed therein which extends between said upper and lower ends;

a hollow metal square shaft having upper and lower ends and inner and outer surfaces;

said shaft being received by said central opening in said base so that its lower end is substantially flush with said bottom surface of said plate portion;

said lower end of said shaft being welded to said base;

said shaft having an enlarged diameter portion immediately above said upper end of said base;

said enlarged portion having a diameter greater than said central opening.

9. The support pole of claim 8 wherein said plate portion has a cut-away portion formed in its bottom surface extending upwardly thereinto which communicates with the lower end of said opening and wherein said lower end outer surface of said shaft is welded to said base by a weldment in said cut-away portion.

10. A support pole, comprising:

a horizontally disposed metal base, having upper and lower ends, for attachment to a footing;

said base having a bottom surface;

said base having a central opening formed therein which extends between said upper and lower ends;

said base having a cut-away portion formed in its bottom surface extending upwardly into said central opening;

a hollow metal shaft having upper and lower ends and inner and outer surfaces;

said shaft being received by said central opening in said base so that its lower end is substantially flush with said bottom surface of said base;

a weldment in said cut-away portion which welds said outer surface of said lower end of said shaft to said base;

said shaft has an enlarged protruding portion immediately above said upper end of said base;

said protruding portion having a diameter greater than said central opening.

11. A support pole, comprising:

a horizontally disposed metal base, having upper and lower ends, for attachment to a footing;

said base having a bottom surface;

said base having a square central opening formed therein which extends between said upper and lower ends;

a hollow, square metal shaft having upper and lower ends and inner and outer surfaces;

said shaft being received by said central opening in said base so that its lower end is substantially flush with said bottom surface of said base;

said lower end of said shaft being welded to said base;

said shaft having an enlarged diameter portion immediately above said upper end of said base;

said enlarged portion having a diameter greater than said central opening.

12. The support pole of claim 11 wherein said base has a square-shaped cut-away portion formed in its bottom surface extending upwardly thereinto which communicates with the lower end of said opening and wherein said lower end outer surface of said shaft is welded to said base by a weldment in said cut-away portion.

* * * * *